United States Patent [19]

Williams

[11] Patent Number: 4,841,683

[45] Date of Patent: Jun. 27, 1989

[54] ROLL GRINDING SYSTEM

[76] Inventor: Clarence W. Williams, P.O. Box 9675, Richmond, Va. 23228

[21] Appl. No.: 137,240

[22] Filed: Dec. 23, 1987

[51] Int. Cl.[4] ..... B24B 21/02

[52] U.S. Cl. ..... 51/142; 51/145 R; 51/252; 51/289 R

[58] Field of Search ..... 51/102, 135 R, 141, 51/142, 144, 145 R, 148, 244, 251, 252, 254, 289 R

[56] References Cited

U.S. PATENT DOCUMENTS

| | | | |
|---|---|---|---|
| 1,096,189 | 5/1914 | Norton . | |
| 1,768,339 | 6/1930 | Stevens | 51/144 X |
| 2,241,568 | 5/1941 | Yetter | 51/141 |
| 2,401,670 | 6/1946 | Spetz . | |
| 2,589,017 | 3/1952 | Moore | 51/144 X |
| 2,664,680 | 1/1954 | Schiavulli et al. | 51/102 X |
| 3,095,674 | 7/1963 | Lee | 51/142 X |
| 3,165,865 | 1/1965 | Bousquet et al. | 51/142 X |
| 3,760,537 | 9/1973 | Bovati | 51/145 R |
| 4,036,275 | 7/1977 | Branick | 51/145 R X |
| 4,291,505 | 9/1981 | Taniishi | 51/289 R |

*Primary Examiner*—Robert P. Olszewski
*Attorney, Agent, or Firm*—John F. C. Glenn

[57] ABSTRACT

Worn rubber-like coating around a printing roll or the like is resurfaced by bringing a regrinder with spaced abrasive belts to the place where the roll operates, and operating the belts to regrind the roll as it is rotated by its operating drive. The regrinder moves along a rail parallel to the roll axis during regrinding, and has mechanism to move the belts into position to begin grinding.

7 Claims, 4 Drawing Sheets

ROLL GRINDING SYSTEM

BACKGROUND OF THE INVENTION

Large rubber rolls are conventionally used in industrial plant equipment for directing the path of travelling webs of paper, for inking other rolls, and the like. When the rolls need resurfacing the established practice has been to remove them for resurfacing elsewhere, with consequent delay and expense. Furthermore, when a roll is reground elsewhere it may be rotated about a slightly different axis and hence its new outer surface may not be accurately concentric with its axis of rotation in the equipment in which it is to be used.

SUMMARY OF THE INVENTION

In accordance with the present invention, industrial rubber rolls are retained in the equipment in which they are used while being rotated and ground to a new surface. This avoids the expense and delay of sending the rolls out, facilitates quality control and correction of errors in regrinding, and assures good operating concentricity.

The regrinding apparatus of the invention is portable and readily set up to move along tracks parallel to the roll axis while grinding against an exposed part of the roll periphery. Regrinding is done by the grinding surface of at least one motor driven belt where it is tangent to and moving in the same direction as the roll surface but faster, or in the opposite direction. Two belts are preferably used, driven by a common motor between them, and moving in spaced parallel planes perpendicular to the roll axis. This permits one belt to grind up to one end of the roll, in cases where the end clearance is limited, and the other belt to grind up to the other end, where clearance is likewise limited. Where end clearances are not limited, both belts can be used at once with the same coarse grit, moving one immediately after the other down the whole length of the roll, in order to grind deeper in one pass; or a coarse belt can precede a fine belt down the length of a roll and thereby do both operations in one pass.

The invention provides efficient means to change the angles of the belt flights against the roll, to the extent necessary to grind an upper or lower or middle part of the roll periphery, and thereby succeed in reaching parts of the periphery which may otherwise be hard to get at for purposes of regrinding at place of use.

The regrinding apparatus is adapted to be raised and lowered and moved laterally or swung toward or from the roll to be ground, preliminary to progressing along the length of the roll during regrinding.

A motor and set of supporting rails are preferably provided to move the grinding apparatus along the rails at a controllable predetermined speed, and to stop automatically at the end of the desired movement.

Other objects, advantages and details of the invention will become apparent as the following disclosure proceeds.

BRIEF DESCRIPTION OF THE DRAWINGS

The accompanying drawings show semi-diagramatically, for purposes of illustration only, a present preferred embodiment of the invention, in which.

DESCRIPTION OF PRESENT PREFERRED EMBODIMENT

Figure 1:
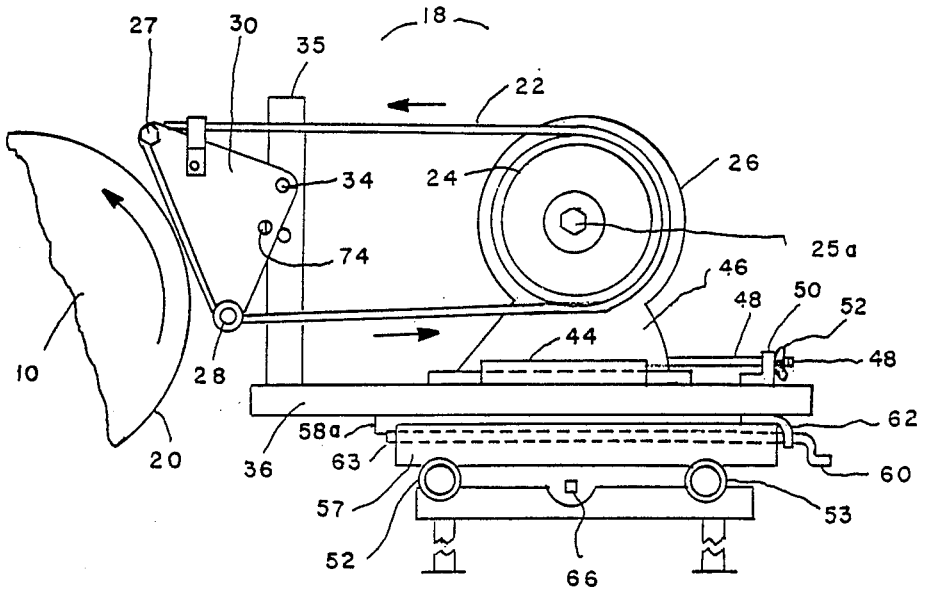
FIG. 1 shows an end view, partially broken away, of an upper part of the periphery of a rubber-covered roll which is to be resurfaced, and a belt grinder mounted on tubular rails to resurface the rolls.
Figure 2:
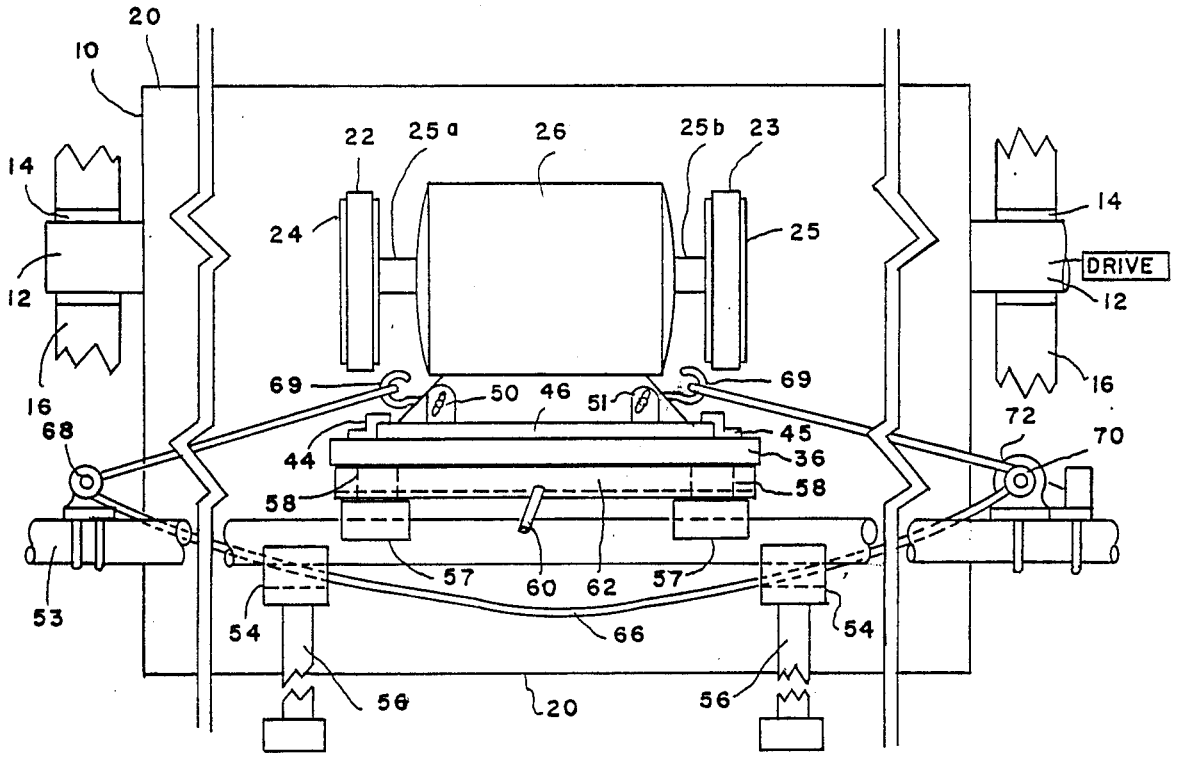
FIG. 2 shows a view, partially broken away, of the apparatus shown in FIG. 1, as seen from the right side of FIG. 1, and with added components for moving the apparatus along its rails.
Figure 3:
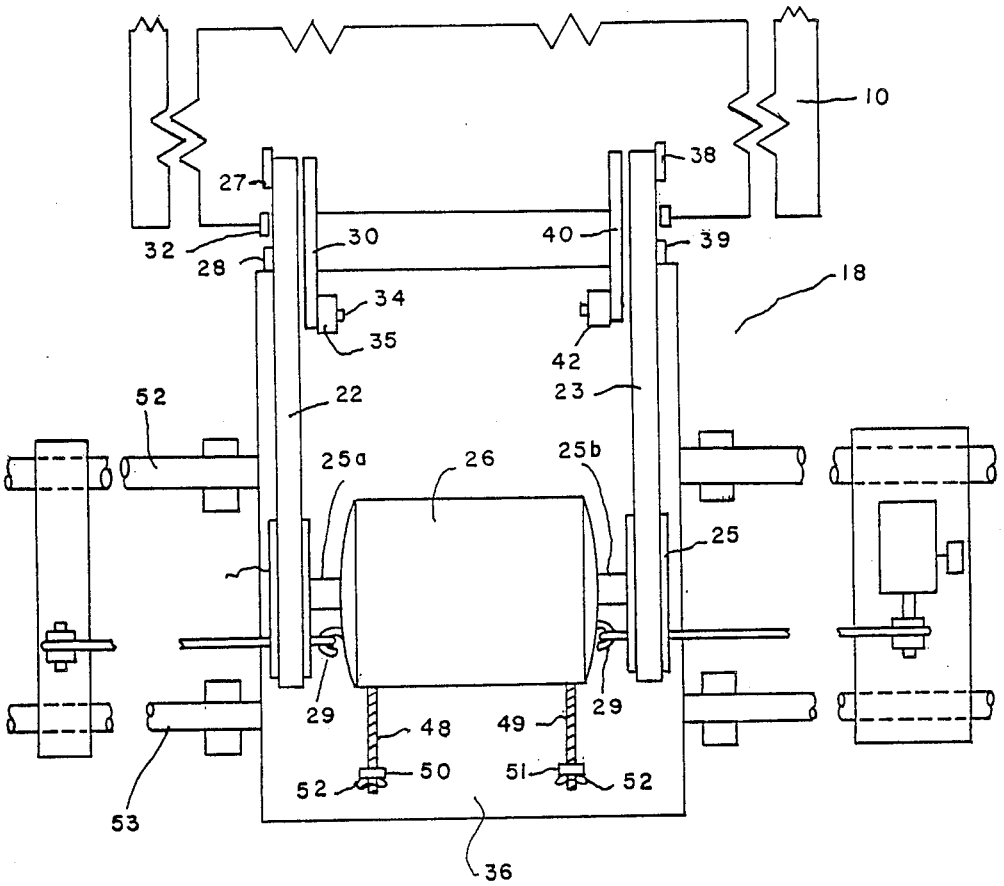
FIG. 3 shows a top elevation, partially broken away, of the apparatus shown in FIG. 2.
Figure 4:
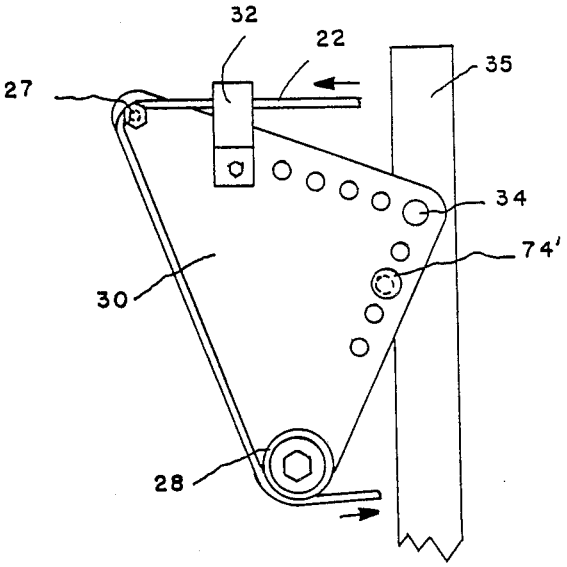
FIG. 4 shows an enlarged view, partially broken away, of the part of the apparatus that holds the grinding belts against the roll.
Figure 5:
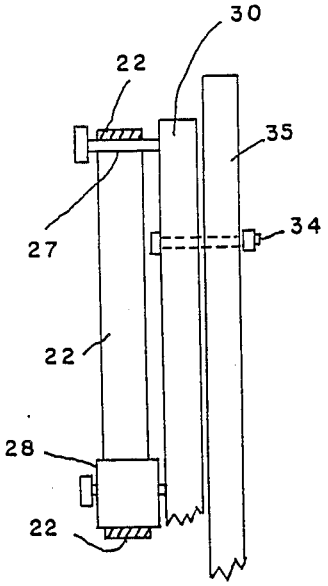
FIG. 5 shows a view, partially broken away, of the apparatus shown in FIG. 4, as seen from the right of FIG. 4 and omitting an auxiliary belt guide shown in FIG. 4.

Referring now more particularly to the drawings, and initially to FIGS. 1 and 2, there is shown a rubber-covered roll 10 for use in guiding a travelling length of paper (not shown) in a printing press or the like, and axles 12 at opposite ends of roll 10 rotate in bearings 14 on a pair of fixed supports 16.

Figure 6:
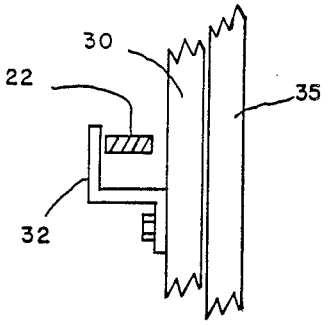
FIG. 6 corresponds to FIG. 5, further broken away and also omitting the belt support drive bar and pulley shown in FIG. 5 but including said auxiliary belt guide.

A belt grinder 18 in accordance with the invention is shown resurfacing roll 10 after it has become worn down or roughened on its outer cylindrical surface 20. The regrinding is done by a pair of closed-loop abrasive belts 22 and 23 driven by pulleys 24 and 25 keyed on oppositely extending drive shafts 25*a* and 25*b* of a motor 26. Belt 22 passes from drive pulley 24 to a drag bar 27 and idler pulley 28 mounted on two corners of a triangular plate 30. It is then pulled back to drive pulley 24. Plate 30 also mounts a bracket carrying a flange 32 for restraining movement of belt 22 away from plate 30 (FIG. 6). A bolt 34 attaches the third corner of plate 30 to a post 35 fixed on a platform 36.

Belt 23 is similarly trained around a drag bar 38 and idler pulley 39 on a corresponding triangular plate 40 bolted to a post 42 fixed on platform 36.

In order to tighten belt 22 a pair of flanges 44 and 45 secure the base 46 of motor 26 to platform 36 so that the motor can slide on platform 36 toward and away from plates 30 and 40 (FIG. 2). A spaced pair of threaded rods 48 and 49 (FIGS. 1 and 2) each have an end fixed to the motor base. Their other ends extend slidably through brackets 50 and 51. Wing nuts 52 (FIG. 1) are threaded on the outer ends of rods 48 and 49 and can be tightened against either or both of brackets 50 and 51 to draw motor 26 selectively away from plates 30 and 40 and thereby tighten either or both of belts 22 and 23 until each is tight enough to prevent flutter against the roll.

Belts 22 and 23 are moved along the length of roll 10 by moving platform 36 along a pair of rails 52 and 53 which extend parallel to each other and to the roll axis. Rails 52 and 53 are secured in grooves in two or more spaced lower cross members 54 resting on posts 56 mounted on the floor or on plant equipment on the floor. Side braces may be added where necessary. A pair of runners 57 extend across the tops of rails 52 and 53 and have grooves underneath to fit around and slide along the upper peripheries of the rails.

The bottom of platform 36 is secured to the top elements 58*a* of a pair of spaced parallel slide assemblies 58. The bottom elements 58*b* of the slide assemblies 58 are secured to the tops of runners 57. Ball bearigs 58*c* in a race 58*d* roll between each set of upper and lower elements. Such slides are used as center mounted drawer slides. The slides 58 extend across rails 52 and 53 and permit movement of platform 36 to carry belts 22 and 23 toward and from roll 10, independently of movement of the platform along the rails. Movement of platform 36 toward and from roll 10 is controlled by rotating a threaded rod 61 which screws through a plate 62 secured to the ends of slide elements 58*a* closest to handle 60. The other end of rod 61 has a swivel connection with a plate 63 secured to the ends of slide elements furthest from handle 60.

A chain 66 controls movement of platform 36 and the whole motor and belts assembly on it along rails 52 and 53. The chain is trained around an idler pulley 68 positioned on rails 52 and 53 beyond one end of roll 10, and around a drive pulley 70 positioned on rails 52 and 53 beyond the other end of roll 10. The ends of the chain are secured by attachments 69 to the base of motor 26. A geared reversible and controllable speed motor 72 drives pulley 70, and a control unit 74 has operating controls connected through cables to each of the motors 26 and 72. When motor 72 turns one way (clockwise in FIG. 2), chain 66 pulls belt motor 26 and with it platform 36 and everything thereon toward chain motor 72. When motor 72 turns the other way, chain 66 is tightened around idler pulley 68 and thereby pulls belt motor 26 and with it platform 36 and everything thereon toward idler pulley 68.

Figure 7:
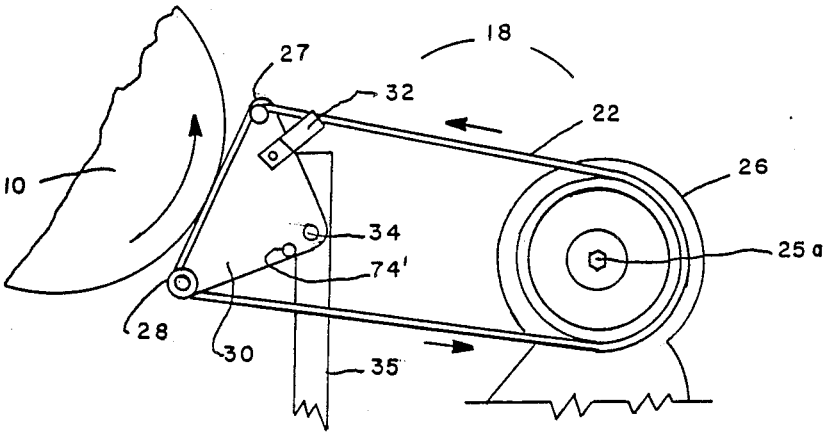
FIG. 7 corresponds to FIG. 1, but is further broken away and modified to show the grinder when adjusted to grind a lower part of the periphery of the roll.
Figure 8:
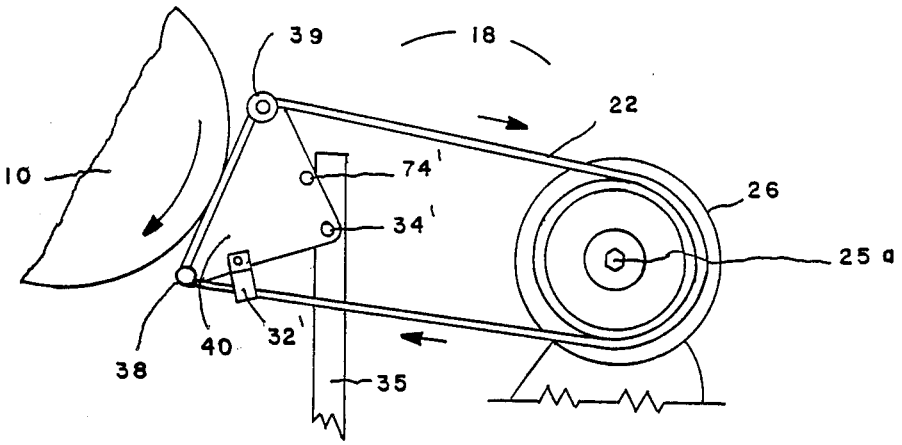
FIG. 8 corresponds to FIG. 7, but shows the roll and belt moving in opposite directions from the movement shown in FIG. 7.
Figure 9:
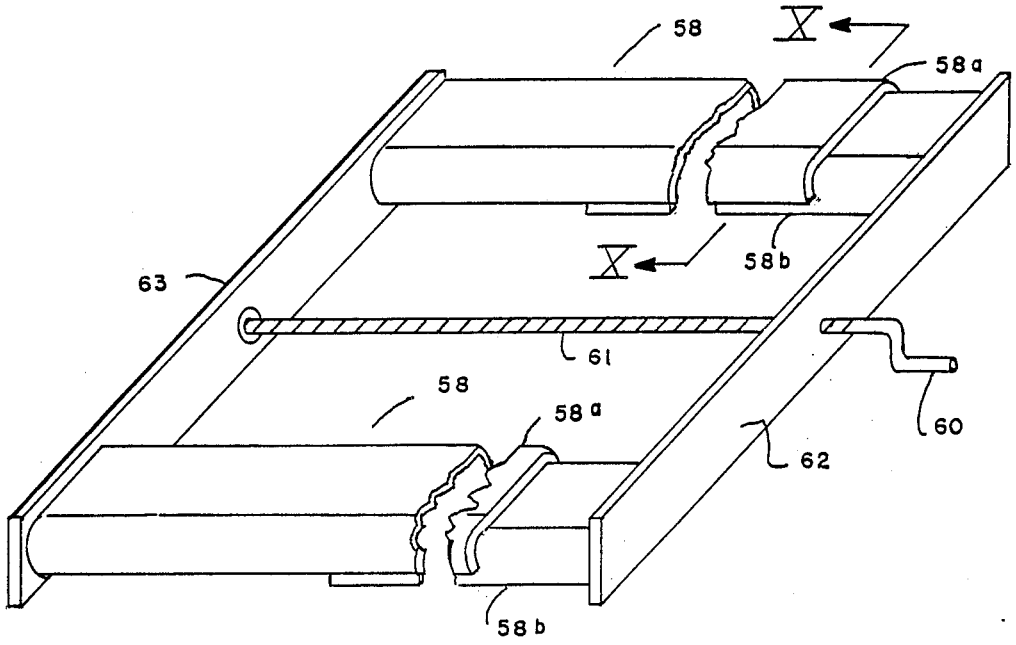
FIG. 9 shows an enlarged isometric view of the pair of slide assemblies used to move the belts toward a roll to be reground, the plates connecting the ends of the slide elements, and a threaded rod and handle rotatable to so move the belts.
Figure 10:
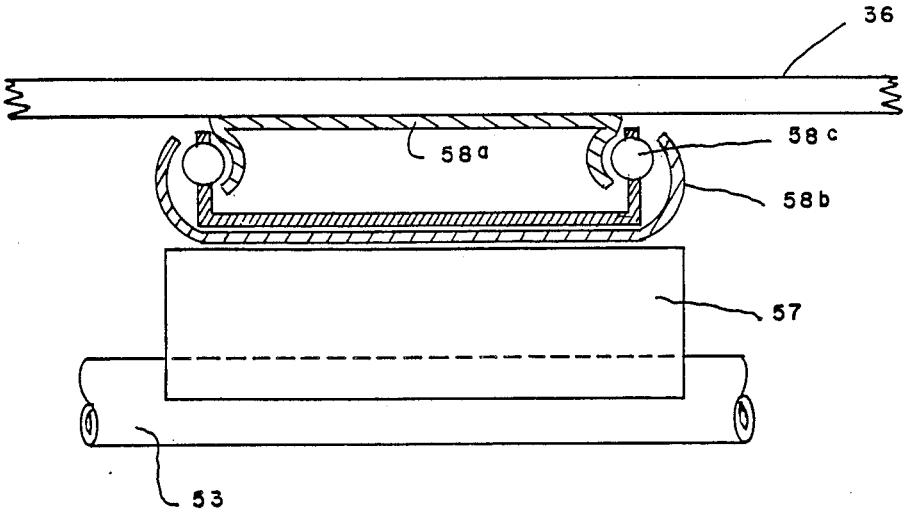
FIG. 10 shows a section of one of the slide assemblies on the line X—X in FIG. 9, with addition of partially broken away connected parts above and below.

When the grinder is to be used for regrinding a roll it is taken to the place where the roll is installed and rails of suitable length (longer than the roll) are set up at an elevation and distance from the roll which will place the belts where they can grind an exposed part of the roll periphery along the whole length of the roll. The angles of the triangular plates 30 are then adjusted to put the belts 22 and 23 in contact with the roll periphery 20 between drag bars 27 and 38 and idler pulleys 28 and 39; see FIGS. 1, 7 and 8. To hold the plates 30 and 40 in the adjusted position a bolt 74 may be seated in one of a series of predrilled openings in plate 30 so that the bolt head (or a nut securing the other end of the bolt) engages post 35 and thereby braces the plate against the pull of the belt supported by the plate. A like bolt is similarly mounted on plate 40 to brace it against post 42.

Once the plates 30 and 40 are adjusted, wing nuts 52 are operated to tighten the belts, handle 60 is operated to position the belts against the roll periphery, motor 72 is operated to position the belts to begin grinding, motor 26 is turned on to drive the belts, and motor 72 is operated to pass the belts down the length of the roll as earlier described. After regrinding the roll is inspected and any further grinding required can be done without further delay.

While present preferred embodiments of the apparatus and method of the invention have been illustrated and described, it will be understood that the invention may be otherwise embodied and practiced within the scope of the following claims.

I claim:

1. Portable apparatus for accurate regrinding of a rubber-like cylindrical surface of a roll being rotated at its work station, comprising a pair of closed loop abrasive belts extending in spaced parallel planes, means to drive the belts, a pair of sets of means in supporting contact with the respective belts, a platform, means mounting the platform to move parallel to the axis of rotation of a roll being reground at its work station, means mounting the platform to move toward and from a roll being so reground, means to hold the platform at a fixed distance from a roll while the platform is moved parallel to the roll's axis, means mounted on the platform to support said sets of belt supporting means, said platform mounted support means including adjustment means to bring said sets of means into tight engagement with the belts, to present a substantially straight length of each belt for substantially tangential grinding contact with the surface of a roll, and to adjust the angle of each said straight length and thereby adjust the position of its contact along a roll's periphery, and said platform mounted support means also including means operable after such adjustment to hold said sets of means in fixed positions relative to the platform during regrinding of a roll, whereby the belts are held at a fixed spacing from a roll for accuracy of regrinding, and whereby, where clearances are limited at the ends of a roll, one belt may grind to one end of the roll and the other belt to the other end of the roll.

2. Portable grinding apparatus according to claim 1, in which said belt driving means comprises a motor mounted on the platform between said parallel belt planes.

3. Portable grinding apparatus according to claim 2, comprising a pair of drive shafts extending from opposite sides of said motor, pulleys mounted on said shafts in driving engagement with said belt, and means for adjusting the mounting of the motor on the platform and thereby tightening the belts.

4. Portable grinding apparatus according to claim 3, in which said adjustable motor mounting means permits movement of one motor shaft more than the other and thereby permits tightening one belt relative to the other.

5. Apparatus according to claim 1, in which each of said sets of belt supporting means comprises a pulley connected to be driven by the belt driving means, a freely rotatable pulley, and a drag member adapted to increase tension in the length of the belt which passes from the drag member to the freely rotatable pulley and is the straight length of belt presented for tangential contact with a roll.

6. Apparatus according to claim 5, in which the means to adjust the angle of the roll contacting length of each belt comprises a member carrying said freely rotatable pulley and drag means, and means mounting said carrying member on the platform for pivotal movement in a plane parallel to the belt planes.

7. Apparatus according to claim 1, in combination with a roll having a rubber-like coating, and means to rotate the roll at its work station.

* * * * *